United States Patent [19]

Miyashita et al.

[11] Patent Number: 4,663,279

[45] Date of Patent: May 5, 1987

[54] METHOD OF BENEFICIATION OF COMPLEX SULFIDE ORES

[75] Inventors: Hiroichi Miyashita; Hajime Nakazawa; Masayuki Hisatsune, all of Niihama, Japan

[73] Assignee: Sumitomo Metal Mining Company Limited, Tokyo, Japan

[21] Appl. No.: 883,280

[22] Filed: Jul. 11, 1986

Related U.S. Application Data

[63] Continuation of Ser. No. 713,706, Mar. 19, 1985, abandoned.

[30] Foreign Application Priority Data

Mar. 21, 1984 [JP] Japan ..... 54-54020

[51] Int. Cl.[4] ..... B03D 1/00; B03C 1/00

[52] U.S. Cl. ..... 423/25; 423/26; 423/100; 75/2

[58] Field of Search ..... 423/25, 26, 100; 75/2

[56] References Cited

U.S. PATENT DOCUMENTS

| | | | |
|---|---|---|---|
| 3,339,730 | 9/1967 | Boutin et al. | 423/26 |
| 4,279,867 | 7/1981 | Weir | 423/26 |
| 4,368,176 | 1/1983 | Abishev et al. | 423/25 |

FOREIGN PATENT DOCUMENTS 20694 5/1974 Japan .

OTHER PUBLICATIONS

"Magnetic Separations in Chemistry and Biochemistry", Hirschbein et al., Chemtech, Mar. 1982, pp. 172–179.

Perry's Chemical Engineers' Handbook, 6th ed., Ed. by Perry et al., McGraw-Hill Book Co., 1984, pp. 21–46, 47.

*Primary Examiner*—John Doll

*Assistant Examiner*—Jeffrey Edwin Russel

*Attorney, Agent, or Firm*—Watson, Cole, Grindle & Watson

[57] ABSTRACT

A method of beneficiation of complex sulfide ores comprises crushing and grinding complex sulfide ore containing sulfides of copper, zinc, iron and other minerals, subjecting the ground ores to differential flotation to obtain a bulk copper-zinc concentrate which is separate from pyrite and gangue, and passing the bulk copper-zinc concentrate through a high-gradient magnetic separator having an open-bore magnetic field filled with a matrix element, so as to recover separately a magnetic copper concentrate and a non-magnetic zinc concentrate. By combining the differential flotation with high-gradient magnetic separation, the present invention enables individual separation of copper and zinc concentrates without using many reagents in high volumes and by a simple process control.

8 Claims, 1 Drawing Figure

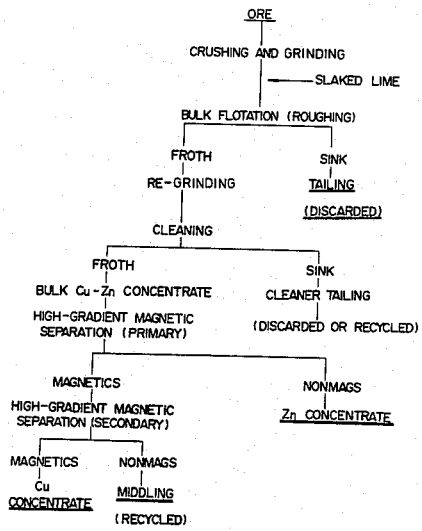

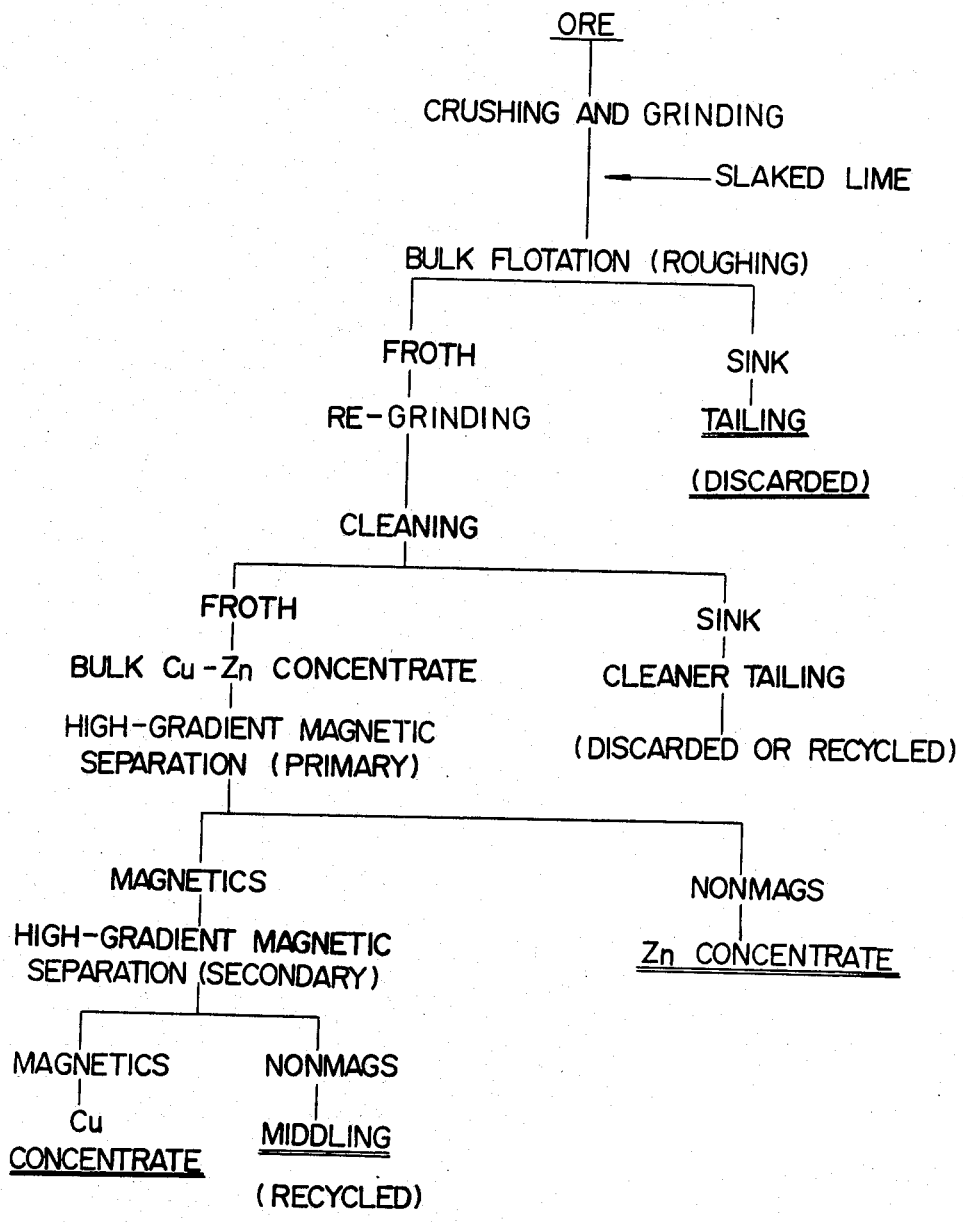
ORE
CRUSHING AND GRINDING
SLAKED LIME
BULK FLOTATION (ROUGHING)
FROTH
SINK
RE-GRINDING
TAILING
(DISCARDED)
CLEANING
FROTH
SINK
BULK Cu-Zn CONCENTRATE
CLEANER TAILING
HIGH-GRADIENT MAGNETIC SEPARATION (PRIMARY)
(DISCARDED OR RECYCLED)
MAGNETICS
NONMAGS
HIGH-GRADIENT MAGNETIC SEPARATION (SECONDARY)
Zn CONCENTRATE
MAGNETICS
NONMAGS
Cu CONCENTRATE
MIDDLING
(RECYCLED)

METHOD OF BENEFICIATION OF COMPLEX SULFIDE ORES

This application is a continuation of application Ser. No. 713,706, filed Mar. 19, 1985, now abandoned.

BACKGROUND OF THE INVENTION

The present invention relates to a method of beneficiation for recovering copper and zinc concentrates separately from complex sulfide ores containing sulfides of copper, zinc, iron and other minerals.

The beneficiation of complex sulfide ores containing copper, zinc, iron and other minerals is generally done by a differential flotation method consisting of two principal steps: in the first step, the copper minerals are floated and sphalerite, pyrite and gangue are depressed with slaked lime, sodium cyanide and zinc sulfate to form a sink; in the second stage, copper sulfate or any other suitable activator is added to the sink so as to obtain an activated sphalerite froth while the pyrite and gangue are depressed to be separated as a sink. However, if the complex sulfide ores have undergone oxidation or other secondary geological reactions in the ore deposit, the respective minerals are so close in their response to flotation that considerable difficulty is encountered in their beneficiation by the conventional differential flotation method.

Japanese Patent Publication No. 15310/1962 proposed the use of sulfur dioxide gas in combination with sodium sulfide and zinc sulfate for the purpose of depressing sphalerite in the complex sulfide ores that had undergone secondary geological reactions, and this method produced some improvement in the results of beneficiation. However, the depression of the sphalerite requires the use of various reagents in high volumes, and the effectiveness of this method depends on using these reagents in the right amounts. The operation of this method therefore requires a high-degree control technology in order to implement a complicated process with a reliable reagent feed apparatus.

Magnetic separation of copper minerals by a strong magnetic field was proposed in Japanese Patent Publication No. 20694/1974. However, this method is unable to produce a copper concentrate of an industrially feasible high grade if the feed contains great amounts of pyrite and other paramagnetic minerals having comparable values of magnetic susceptibility.

The complex sulfide ores taken from mine A in Canada consist of chalcopyrite, bornite, sphalerite, pyrite and gangue. The ores have the following composition (wt%):

| Cu | Zn | Pb | S | Fe | $SiO_2$ | $Al_2O_3$ | CaO | MgO |
|---|---|---|---|---|---|---|---|---|
| 1.67 | 2.31 | 0.06 | 31.26 | 27.21 | 12.8 | 3.75 | 1.78 | 3.85 |

Analysis by EPMA (Electron Probe Microanalyzer) showed that the iron value in the sphalerite was 0.2–1.0 wt%. Having being subjected to oxidation in the ore deposits, these sulfide ores defined selective depression of the sphalerite by slaked lime, sodium cyanide and zinc sulfate in accordance with the conventional differential flotation technique. An attempt was made to enrich and recover the copper minerals from these ores by enhanced magnetic separation in accordance with the method shown in Japanese Patent Publication No. 20694/1974; first, the strongly magnetic materials were removed by a conventional magnetic separator with a field strength of 1,000 Gauss; then, the remainder was passed through an iso-dyanamic separator with a field strength of 15,000 Gauss. The results are shown in Table 1 below; the weakly magnetic materials had low copper values and copper concentrates of sufficiently high grade to be used industrially could not be obtained.

TABLE 1

| Product | Weight % | Assays (%) Cu | Assays (%) Zn | Recovery (%) Cu | Recovery (%) Zn |
|---|---|---|---|---|---|
| Mill feed | 100.00 | 1.67 | 2.22 | 100.00 | 100.00 |
| Strong magnetics | 0.45 | 0.32 | 1.42 | 0.09 | 0.29 |
| Weak magnetics | 18.90 | 6.35 | 0.56 | 71.89 | 4.77 |
| Nonmags | 80.65 | 0.58 | 2.61 | 28.02 | 94.94 |

As shown above, the recovery of copper minerals and sphalerite from complex sulfide ores conventionally requires the use of many reagents in large amounts and can only be realized through complicated procedures using high-degree process control technology.

SUMMARY OF THE INVENTION

The primary purpose of the present invention, therefore, is to achieve efficient separate recovery of the copper minerals and sphalerite as copper and zinc concentrates by the combination of a method of differential flotation of bulk Cu-Zn concentrate that is simple and can be accomplished without using many reagents in large amounts, and a subsequent step of magnetic separation.

This object can be achieved by a method of beneficiation of complex sulfide ores which comprises crushing and grinding complex sulfide ores containing sulfides of copper, zinc, iron and other minerals, subjecting the ground ores to the ordinary type of differential flotation to obtain a bulk copper-zinc concentrate which is separate from pyrite and gangue, and passing the bulk copper-zinc concentrate through a high-gradient magnetic separator having an open-bore magnetic field filled with a matrix element, so as to recover separately a magnetic copper concentrate and a nonmagnetic zinc concentrate.

BRIEF DESCRIPTION OF THE DRAWING

The drawing is a flowsheet for one embodiment of the beneficiation of complex sulfide ores in accordance with the present invention.

DETAILED DESCRIPTION OF THE INVENTION

In the present invention, differential separation is effected in order to float the copper minerals while depressing pyrite and gangue minerals, and this can be done by various known methods using a combination of depressants such as alkalis, sodium cyanide, starch and ligninsulfonates, with collectors such as xanthates, dithiophosphates and thionocarbamates. The bulk copper-zinc concentrate that is fed to the high-gradient magnetic separator preferably has a particle size that enables individual separation of the copper and zinc minerals, and a typical size is 150 μm or less.

The high-gradient magnetic separator used in the present invention consists of a magnet coil filled with a matrix element that is made of ferromagnetic wires for concentrating the magnetic lines of force produced by the magnet coil. For the purpose of the present invention, the open-bore magnetic field should have a strength of at least 4,000 Oe, below which the recovery of the copper concentrate is decreased. An open-bore magnetic field having a strength exceeding 20,000 Oe does not provide any corresponding advantage, and instead, the fabrication of the magnetic separator becomes uneconomic or the power consumption is increased. Therefore, the open-bore magnetic field used in the present invention most preferably has a strength in the range of 4,000 to 20,000 Oe. The matrix element placed within the magnetic field preferably consists of ferromagnetic wires of a fineness of 800 μm or below (the fineness refers to the diameter of a round wire and to the longer side of a wire with a rectangular cross-section). With thicker wires, the recovery of the copper concentrate is reduced. Wires with a fineness of 100 μm or below are not preferred since they provide a matrix of such a fine mesh that not only magnetic but also mechanical trapping occurs.

The feed rate through the magnetic separator is preferably in the range of 50 to 500 m/hr. If the feed rate is lower than 50 m/hr, zinc minerals are entrapped by the matrix element and reduce the value of the recovered copper concentrate. A feed rate higher than 500 m/hr is also undesired because it reduces the recovery of the copper concentrate.

The present invention is hereunder described in greater detail by reference to the following examples which are given here for illustrative purposes only and are by no means intended to limit the scope of the invention.

EXAMPLE 1

A sample of the complex sulfide ores taken at mine A, Canada, having the specifications shown above were treated by the present invention in accordance with the procedures shown in the accompanying flowsheet. The ground ores were conditioned to a pH of 12 with slaked lime and subjected to the conventional form of differential flotation so as to recover a bulk copper-zinc concentrate (−325 mesh: 85%) while depressing pyrite and gangue minerals. This bulk concentrate was passed through a magnetic separator comprising an open-bore magnetic field (19,500 Oe) filled with an expanded metal matrix element (a screen of fine square wires of ca. 250×250 μm) at a feed rate of 180 m/hr The non-magnetics were recovered as the zinc concentrate. The magnetics were further passed through another high-gradient separator under the same conditions as used above. The copper concentrate was recovered as magnetics, and middlings that could be returned to a suitable step in the benefication system for further treatment were obtained as non-magnetics. The results of the two cycles of magnetic separation are summarized in Table 2, wherein the weight and recovery of the bulk Cu-Zn concentrate fed to the first high-gradient magnetic separator are taken as 100.

TABLE 2

| Product | Weight % | Assays (%) Cu | Zn | S | Fe | Recovery (%) Cu | Zn |
|---|---|---|---|---|---|---|---|
| Bulk Cu—Zn concentrate | 100.00 | 15.25 | 24.05 | 37.24 | 22.21 | 100.00 | 100.00 |
| Cu concentrate | 61.26 | 23.29 | 7.74 | 38.52 | 29.59 | 93.58 | 19.72 |
| Middlings | 3.51 | 5.98 | 24.44 | 41.88 | 25.85 | 1.38 | 3.57 |
| Zn concentrate | 35.23 | 2.18 | 52.37 | 34.55 | 9.01 | 5.04 | 76.71 |

EXAMPLE 2

A sample of the complex sulfide ores that were taken at mine A in Canada but which differed from those used in Example 1 was treated as in Example 1 to obtain a bulk copper-zinc concentrate (−325 mesh: 82%). This concentrate was passed through a high-gradient magnetic separator at a feed rate of 350 m/hr. The separator was the same as used in Example 1 and the open-bore magnetic field had a strength of 19,500 Oe. Magnetics were passed through another high-gradient magnetic separator of the same type under the same conditions. The middlings obtained in this Example had a low copper content and were combined with the zinc concentrate. The results of the two cycles of magnetic separation are shown in Table 3.

| Ore Composition (wt %): | | | | | | | | |
|---|---|---|---|---|---|---|---|---|
| Cu | Zn | Pb | S | Fe | $SiO_2$ | $Al_2O_3$ | CaO | MgO |
| 1.97 | 2.10 | 0.06 | 28.22 | 24.01 | 13.5 | 3.94 | 7.06 | 4.69 |

TABLE 3

| Product | Weight % | Assays (%) Cu | Zn | S | Fe | Recovery (%) Cu | Zn |
|---|---|---|---|---|---|---|---|
| Bulk Cu—Zn concentrate | 100.00 | 17.91 | 25.20 | 35.35 | 19.55 | 100.00 | 100.00 |
| Cu concentrate | 62.82 | 27.13 | 6.57 | 36.78 | 28.02 | 95.14 | 16.38 |
| Zn concentrate | 37.18 | 2.34 | 56.69 | 32.93 | 5.23 | 4.86 | 83.62 |

COMPARATIVE EXAMPLE

A sample of the complex sulfide ores taken from mine A in Canada and having the same composition as in Example 1 was subjected to the conventional form of differential flotation wherein the ground feed was conditioned to a pH of 12 with slaked lime and pyrite and gangue minerals were recovered as tailings. After repeated cleaning flotation, a mineral pulp containing about 40 wt% of the bulk copper-zinc concentrate was obtained. After concentrating the mineral pulp to about 60 wt%, 6000 g of sodium sulfide per ton of the bulk concentrate was added to the pulp. After addition of 7,000 g of zinc sulfate and 4,000 g of sulfur dioxide gas per ton of the bulk concentrate, the pulp was mixed with collectors and frothers and subjected to repeated cleaning flotation for recovering copper and zinc concentrates. The results of this conventional flotation are summarized in Table 4.

TABLE 4

| Product | Weight % | Assays (%) Cu | Zn | S | Fe | Recovery (%) Cu | Zn |
|---|---|---|---|---|---|---|---|
| Bulk Cu—Zn concentrate | 100.00 | 14.54 | 24.61 | 37.11 | 22.23 | 100.00 | 100.00 |
| Cu concentrate | 47.55 | 23.42 | 5.48 | 39.02 | 31.09 | 76.57 | 10.59 |
| Middlings | 16.16 | 3.82 | 23.10 | 43.80 | 28.60 | 4.24 | 15.17 |
| Zn concentrate | 36.29 | 7.69 | 50.35 | 31.64 | 7.78 | 19.19 | 74.24 |

As is clear from the results in Examples 1 and 2 and the Comparative Example, the copper and zinc concentrates obtained by the method of the present invention respectively have industrially feasible Cu and Zn values, and the copper and zinc recoveries relative to the bulk Cu-Zn concentrate are 17–18% and 2–9% higher than those obtained in the comparative Example. As other advantages, the process is simpler, consumes lesser amounts of reagents and can be operated with an easier method of control.

It is essential for the purpose of the present invention that pyrite and gangue minerals be removed by bulk differential flotation before effecting magnetic separation with a high-gradient magnetic separator. The technical advantages of the present invention originate from this combination of bulk differential flotation with a high-gradient magnetic separator.

What is claimed is:

1. A method of beneficiation of complex sulfide ores which contain chalcopyrite, bornite, sphalerite, pyrite and gangue, said method comprising the steps of (a) crushing and grinding said complex sulfide ores, (b) subjecting the ground and crushed ores obtained in step (a) to differential flotation to obtain a bulk copper-zinc concentrate which is separate from pyrite and gangue, and (c) directly passing the bulk copper-zinc concentrate obtained in step (b) through a high-gradient magnetic separator having an open-bore magnetic field filled with a matrix element so as to recover separately a magnetic copper concentrate and a non-magnetic zinc concentrate.

2. The method according to claim 1, wherein in step (b) said differential flotation is effected by a combination of depressants with collectors.

3. The method according to claim 2, wherein said depressants are selected from the group consisting of alkalis, sodium cyanide, starch and ligninsulfonates.

4. The method according to claim 2, wherein said collectors are selected from the group consisting of xanthates, dithiophosphates and thionocarbamates.

5. The method according to claim 1, wherein said bulk copper-zinc concentrate is composed of particles having average diameters of 150 μm or less.

6. The method according to claim 1, wherein said open-bore magnetic field has a strength of 4,000 to 20,000 Oe.

7. The method according to claim 1, wherein said matrix element contains wires having maximum cross sectional dimensions of 100 to 800 μm.

8. The method according to claim 1, wherein in step (c) said bulk copper-zinc concentrate is passed through said magnetic separator at a feed rate of 50 to 500 m/hr.

* * * * *